US007937966B2

(12) United States Patent
Golove et al.

(10) Patent No.: US 7,937,966 B2
(45) **Date of Patent: *May 10, 2011**

(54) JEWELRY WITH INTERCHANGEABLE SETTINGS AND ATTACHABLE CHARMS AND METHODS FOR THEIR USE

(75) Inventors: Beth Golove, Winter Garden, FL (US); Mark Kaplan, Fair Lawn, NJ (US); Daniele E. Paglia, Far Hills, NJ (US); Steven Kerner, Manalapan, NJ (US)

(73) Assignee: Beth Glove, Syosset, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/816,249

(22) PCT Filed: Feb. 14, 2006

(86) PCT No.: PCT/US2006/005055

§ 371 (c)(1), (2), (4) Date: Dec. 17, 2008

(87) PCT Pub. No.: WO2006/091418

PCT Pub. Date: Aug. 31, 2006

(65) Prior Publication Data

US 2009/0100869 A1 Apr. 23, 2009

(51) Int. Cl.
*A44C 13/00* (2006.01)

(52) U.S. Cl. ..... 63/40; 63/29.1

(58) Field of Classification Search ..... None
See application file for complete search history.

(56) References Cited

U.S. PATENT DOCUMENTS

| | | | |
|---|---|---|---|
| 296,312 | A | 4/1884 | Bulova |
| 359,717 | A | 3/1887 | Dreyfus |
| 367,414 | A | 8/1887 | Lamont |
| 635,510 | A | 10/1889 | Saunders |
| 417,569 | A | 12/1889 | Margileth |
| 466,287 | A | 12/1891 | Berlepsch |
| 732,532 | A | 6/1903 | Fallek |
| 758,848 | A | 5/1904 | Pejchar |
| 1,166,431 | A | 1/1916 | Capwell |
| 1,176,028 | A | 3/1916 | Botlield |
| 1,179,025 | A | 4/1916 | Molinaro |
| 1,308,011 | A | 6/1919 | Gilsey |
| 1,691,445 | A | 11/1928 | Meliodon |
| 1,877,442 | A | 9/1932 | Armstrong |
| 2,074,643 | A | 3/1937 | Domenego |

(Continued)

OTHER PUBLICATIONS

Price, Jodi. "Beadworx.com—Lampwork Charm Rings by Jodi Price." GlassArtists.org. Catalog cover. (2 pages).

(Continued)

*Primary Examiner* — Jack W. Lavinder
(74) *Attorney, Agent, or Firm* — Gordon & Jacobson, PC

(57) ABSTRACT

An item of jewelry includes a movable or removable setting and a charm coupled to a short chain. The chain carrying the charm can be captured by the movable or removable setting. According to one embodiment, the setting has internal threads which mate with a threaded post. According to another embodiment, the setting is coupled to a slotted basket via a bayonet coupling. The charms are preferably provided in a wide range of designs, including, but not limited to holiday themes, religious themes, astrological signs, varsity letters, graduation year, wedding themes, commercial characters such as Disney characters, TV characters, messages such as "I Love You", etc. The settings may include different color stones to match different color clothing, birth stones, etc.

14 Claims, 15 Drawing Sheets

U.S. PATENT DOCUMENTS

| | | | | |
|---|---|---|---|---|
| D109,800 | S | | 5/1938 | Foss |
| 2,316,225 | A | | 4/1943 | DeHoffman |
| 2,354,513 | A | | 7/1944 | Fitzer |
| 2,514,231 | A | | 7/1950 | Fous |
| 2,519,152 | A | | 8/1950 | Piotrowski |
| 2,586,787 | A | | 2/1952 | Conto et al. |
| 2,797,561 | A | * | 7/1957 | Vaughn ..... 63/13 |
| 2,883,048 | A | | 4/1959 | Lentz |
| 3,039,279 | A | | 6/1962 | Bussel |
| 3,115,758 | A | | 12/1963 | Eberle et al. |
| 3,180,112 | A | | 4/1965 | Lefkowitz |
| 3,273,766 | A | | 9/1966 | Cosentino |
| 3,643,467 | A | | 2/1972 | Postel |
| 3,739,598 | A | | 6/1973 | Postel |
| 3,751,795 | A | | 8/1973 | Favre |
| 4,216,567 | A | | 8/1980 | Heinz |
| 4,259,850 | A | | 4/1981 | Lalieu |
| 4,353,124 | A | | 10/1982 | Weinzettel et al. |
| 4,353,225 | A | | 10/1982 | Rogers |
| 4,519,220 | A | | 5/1985 | Burrell |
| 4,794,766 | A | | 1/1989 | Schunk et al. |
| 4,879,882 | A | | 11/1989 | Johnson et al. |
| 4,936,115 | A | | 6/1990 | Mesica |
| 4,977,757 | A | | 12/1990 | Messica et al. |
| 4,982,581 | A | | 1/1991 | Furuyama |
| 5,018,365 | A | | 5/1991 | Luceno |
| 5,022,237 | A | | 6/1991 | Monderer et al. |
| 5,069,045 | A | | 12/1991 | Mejias |
| 5,077,987 | A | | 1/1992 | Leith, III |
| 5,077,989 | A | | 1/1992 | Dillabaugh |
| 5,097,679 | A | | 3/1992 | Johnson et al. |
| 5,115,649 | A | | 5/1992 | Amber |
| 5,456,095 | A | | 10/1995 | Tawil et al. |
| 5,887,448 | A | | 3/1999 | Gilbert et al. |
| 5,987,919 | A | | 11/1999 | Hooser |
| 5,992,177 | A | | 11/1999 | Beard |
| 6,032,485 | A | | 3/2000 | Steinberg |
| 6,053,009 | A | | 4/2000 | Broggian |
| 6,116,054 | A | | 9/2000 | Czupor |
| 6,164,292 | A | | 12/2000 | Di Maria Poole et al. |
| 6,357,261 | B1 | | 3/2002 | Cheng |
| 6,370,912 | B1 | | 4/2002 | Sutton |
| 6,408,647 | B1 | | 6/2002 | Koll |
| 6,412,304 | B1 | | 7/2002 | Adelman |
| 6,415,629 | B1 | | 7/2002 | Chan |
| 6,581,413 | B1 | | 6/2003 | Kadosh |
| 6,698,238 | B1 | | 3/2004 | Cheng |
| 6,763,681 | B1 | | 7/2004 | Klundt |
| 6,810,685 | B2 | | 11/2004 | Esposito, Jr. |
| 7,124,477 | B2 | * | 10/2006 | Boland ..... 24/116 A |
| 2002/0020191 | A1 | | 2/2002 | Chan |
| 2004/0177647 | A1 | | 9/2004 | Dennis |
| 2005/0210920 | A1 | | 9/2005 | Kourakis |

OTHER PUBLICATIONS

"Charm Rings" JF Designs Jewelry. Catalog. (1 page).

Shop Intuition charm rings, 2004. Catalog. (1 page).

"Initial Charm Ring," Earth's Treasure, 2005. Catalog. (4 pages).

* cited by examiner

JEWELRY WITH INTERCHANGEABLE SETTINGS AND ATTACHABLE CHARMS AND METHODS FOR THEIR USE

BACKGROUND OF THE INVENTION

1. Field of the Invention

This invention relates broadly to jewelry. More particularly, this invention relates to rings, necklaces, earrings, bracelets, and pendants having interchangeable and/or movable settings and attachable charms.

2. State of the Art

Jewelry is a very popular accessory, particularly among women and girls. Finger rings, bracelets and necklaces are the most popular jewelry items. Rings typically have one or more settings which carry precious or semi-precious stones. Bracelets and necklaces sometimes have hanging pendants or charms. Charm bracelets are unique in that one typically collects charms to be added to the bracelet over time. The charms usually commemorate some event, holiday, milestone, etc. Once added to the bracelet, however, charms generally are not easily removed. Eventually, the bracelet becomes full of charms and no more can be added.

SUMMARY OF THE INVENTION

It is therefore an object of the invention to provide a new and interesting item of jewelry.

It is another object of the invention to provide an item of jewelry which combines features of bracelets, rings, necklaces, earrings, and pendants.

It is a further object of the invention to provide an item of jewelry which is easily adaptable to suit the whim of the wearer.

In accord with these objects, which will be discussed in detail below, an item of jewelry according to the invention includes a removable or movable setting and a charm coupled to a short chain which is captured by the setting. The setting is removably or movably coupled to a ring, a pendant, a bracelet, an earring, or a necklace. According to one embodiment, the setting is removably threaded and the item of jewelry includes a threaded post which mates with the setting. In this embodiment the charms are coupled to washers or loops which fit over the threaded post. The presently preferred washers have ears so that multiple charms can be attached to the post with the washers lying flat relative to each other. In another embodiment, a safety catch is provided to prevent the setting from accidentally disengaging from the threaded post. The threaded post may be part of a ring, a pendant, a bracelet, an earring, or a necklace. The removable setting is preferably interchangeable with other settings. The interchangeable charms are preferably provided in a wide range of designs, including, but not limited to holiday themes, religious themes, astrological signs, varsity letters, graduation year, wedding themes, commercial characters such as Disney characters, TV characters, messages such as "I Love You", etc. The interchangeable settings may include different color stones to match different color clothing, birth stones, etc., or may provide different motifs such as initials.

According to a second embodiment, the removable setting is cylindrical with peripheral bayonet lock slots. The item of jewelry includes a slotted cylinder with a pair of interior bosses which are arranged to engage the bayonet lock slots on the setting. Charms are provided with ball (or other engagement shape) and chain. The balls are arranged inside the slotted cylinder with the chains extending through the slots. The balls and slots are dimensioned to prevent passage of the balls through the slots. After the charms are so arranged, the setting is attached. Preferably, a spring is arranged between the setting and the slotted cylinder.

According to a third embodiment which is similar to the second embodiment, the setting is not removable but is simply movable. In this embodiment, the setting is provided with a post and the item of jewelry is provided with a cylinder which receives the post. The cylinder is provided with an interior groove and the post is provided with an orthogonal boss which engages the groove. A spring is arranged around the cylinder and biases the setting away from the item of jewelry. Rotating the setting in one direction unlocks the setting and permits the setting to move up relative to the item of jewelry, making room for the balls of the charms to be placed in the slots. The setting may be moved against the spring to close over the slots capturing the balls of the charms. Rotation of the setting in the opposite direction locks the setting relative to the item of jewelry.

According to a fourth embodiment which is similar to the third embodiment, the setting post is actually a cylinder and the spring is contained therein so that it is not visible. The fourth embodiment operates in the same manner as the third embodiment.

According to a fifth embodiment, the setting is removably coupled to the jewelry via one or more magnets.

Additional objects and advantages of the invention will become apparent to those skilled in the art upon reference to the detailed description taken in conjunction with the provided figures.

DETAILED DESCRIPTION OF THE PREFERRED EMBODIMENT

Figure 1:
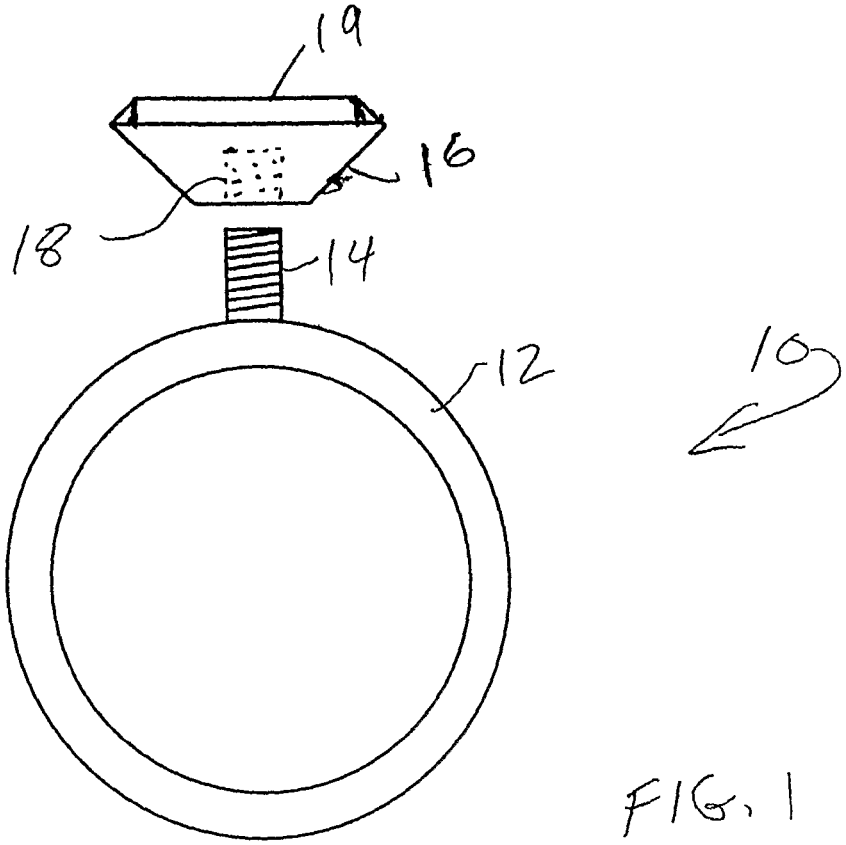
FIG. 1 is a schematic exploded side elevation view of a ring according to a first embodiment of the invention.

Turning now to FIG. 1, a finger ring 10 according to the invention includes a closed loop 12 which is dimensioned to fit comfortably over the wearer's finger, a radially outward extending threaded post 14, and a setting 16 having internal threads 18. The setting 16 preferably receives and holds a precious or semi-precious stone 19. As used herein, the term "stone" means something held by a setting for display. It is not necessarily a precious or semi-precious gemstone or even a simulation of a gemstone, as it may be a precious or other metal providing a decoration or motif, glass, crystal, etc. If desired, a safety latch (not shown) can be provided to latch the setting to the ring and/or stem.

From the foregoing, those skilled in the art will appreciate that the setting 16 is removable from and attachable to the post 14. Thus, a plurality of settings holding different stones may be interchangeably attached to the post 14 resulting in different style rings. The stones in the interchangeable settings may include different color stones to match different color clothing, birth stones, etc., or a metal "stone" with a motif or decoration. Settings which hold multiple stones may also be used. The settings are preferably made from a precious metal such as silver, gold, or platinum. However, in order to provide a ring affordable by teenage or younger girls, the settings can be made of "white metal" and the stones can be made of inexpensive materials including metal, glass or plastic.

Figure 2:
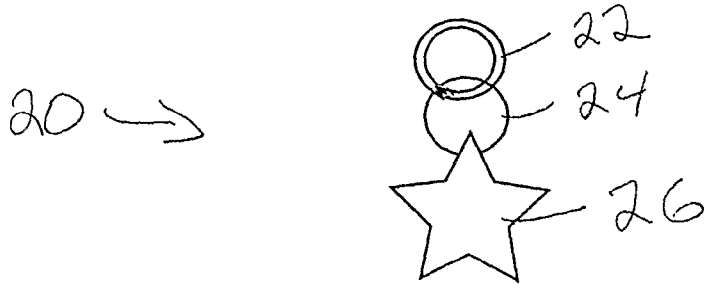
FIG. 2 is a schematic side elevation view of a charm according to the invention.

Referring now to FIG. 2, a charm 20 according to the invention includes a loop 22 coupled by one or more chain links or loops 24 to a charm element 26. According to the invention, the charms are preferably provided in a wide range of designs, including, but not limited to holiday themes, religious themes, astrological signs, varsity letters, graduation year, wedding themes, commercial characters such as Disney characters, TV characters, messages such as "I Love You", etc.

Figure 3:
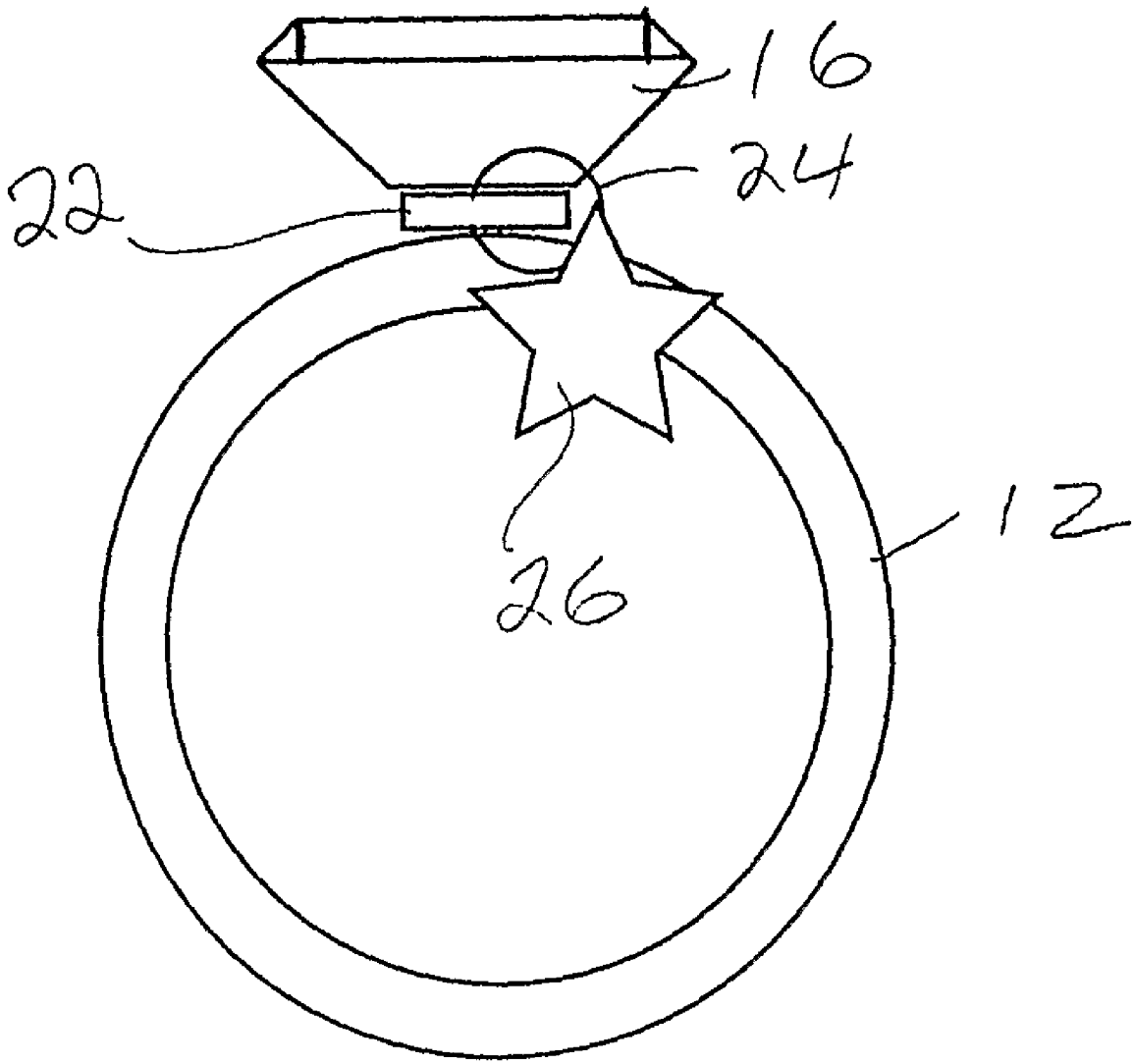
FIG. 3 is a schematic side elevation view of the charm attached to the ring.
Figure 4:
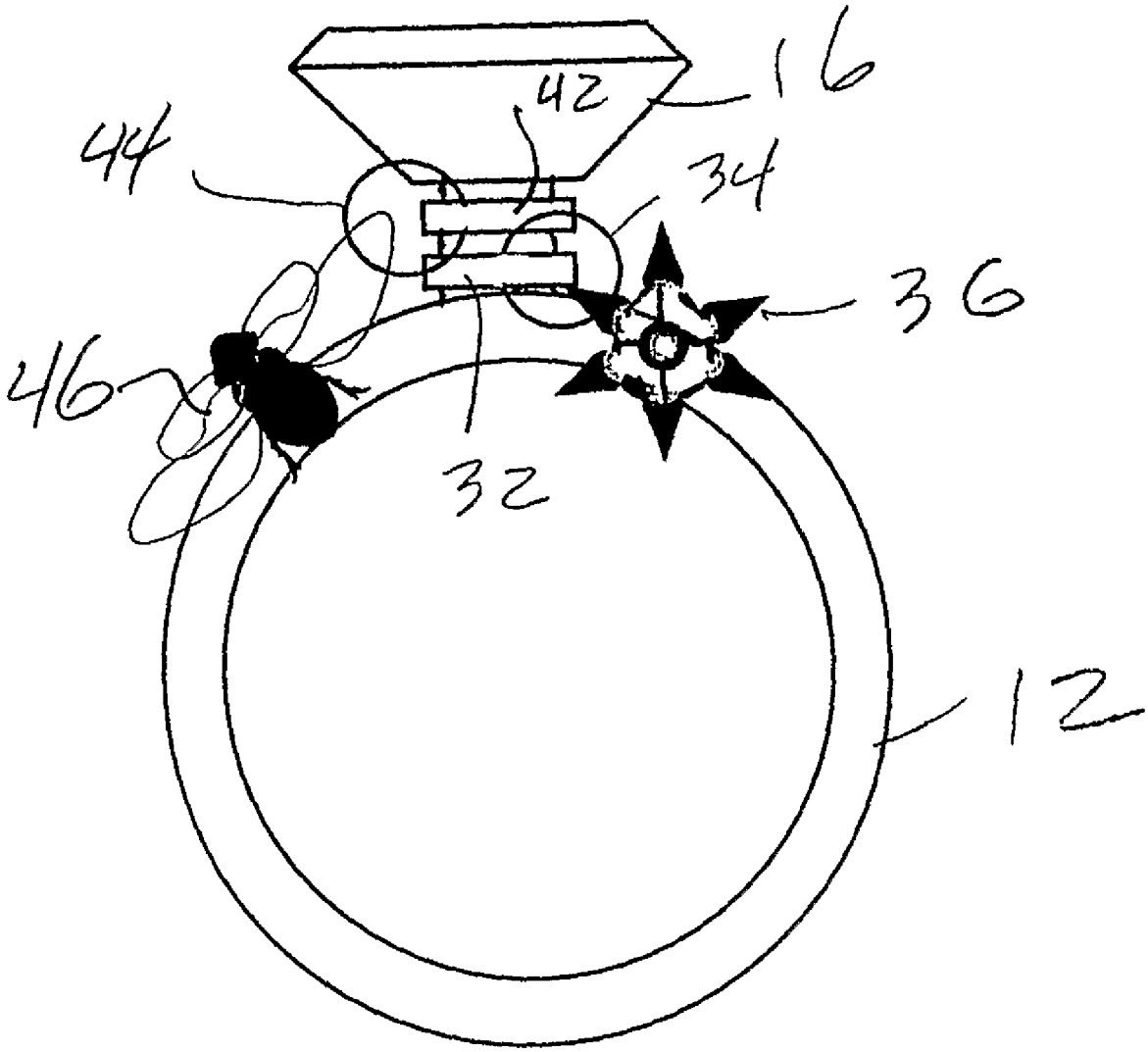
FIG. 4 is a view similar to FIG. 3 showing multiple charms attached to the same ring.

Turning now to FIG. 3 and with reference to FIGS. 1 and 2, according to the methods of the invention, the setting 16 is separated from the post 14 as shown in FIG. 1. The loop 22 of the charm 20 is placed over the post 14 and the setting is 16 is reattached to the post as shown in FIG. 3. The chain link(s) 24 form(s) a chain which is preferably short enough so that when it is attached to the post, the charm does not hang between the wearer's fingers. According to the preferred methods of the invention, up to three or more charms may be attached to the ring at any one time. FIG. 4 shows a ring with two charms 36 and 46 each coupled to a chain link 34, 44 coupled to a loop 32, 42. The loops 32, 42 are positioned over the post as shown with the setting on top. It will be appreciated that in order to accommodate multiple charms, the post may need to be elongated beyond the depth of the internal threads in the setting. If this is the case, blank spacer loops (i.e. without a charm) may be provided to cover exposed portions of the stem when fewer than the maximum number of charms are attached.

Figure 6:
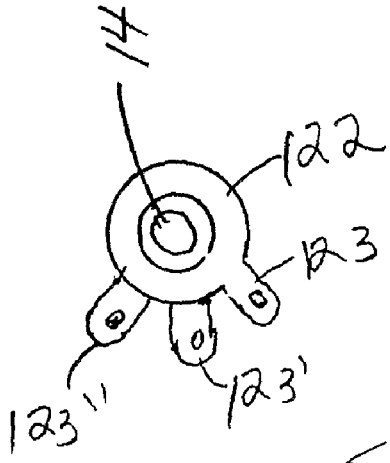
FIG. 6 is a schematic top view of three washers according to the invention.
Figure 5:
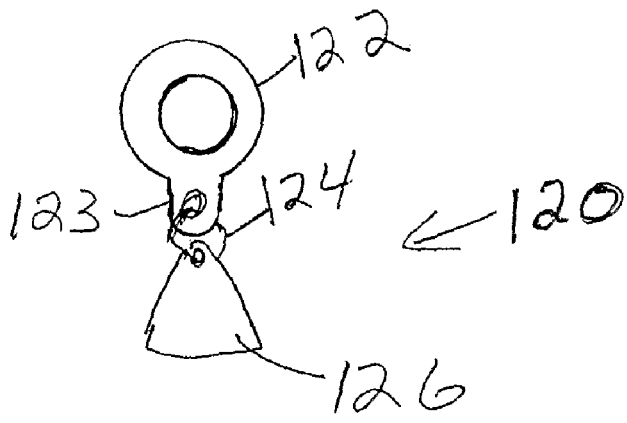
FIG. 5 is a schematic side elevation view of another charm according to the invention.

FIG. 5 shows an alternate embodiment of a charm 120. The charm includes a loop 122 coupled by a link 124 to a charm element 126. According to this embodiment, the loop 122 has an ear 123 through which the link 124 extends. This ear allows the stacking of several loops on a post as shown for example in FIG. 6 (with the charm elements and links removed for clarity). There it can be seen that three loops having ears 123, 123', and 123" are placed over post 14 with the ears circumferentially spaced apart. This arrangement allows the loops 122 to lie flat without the links 124 interfering.

Figure 7:
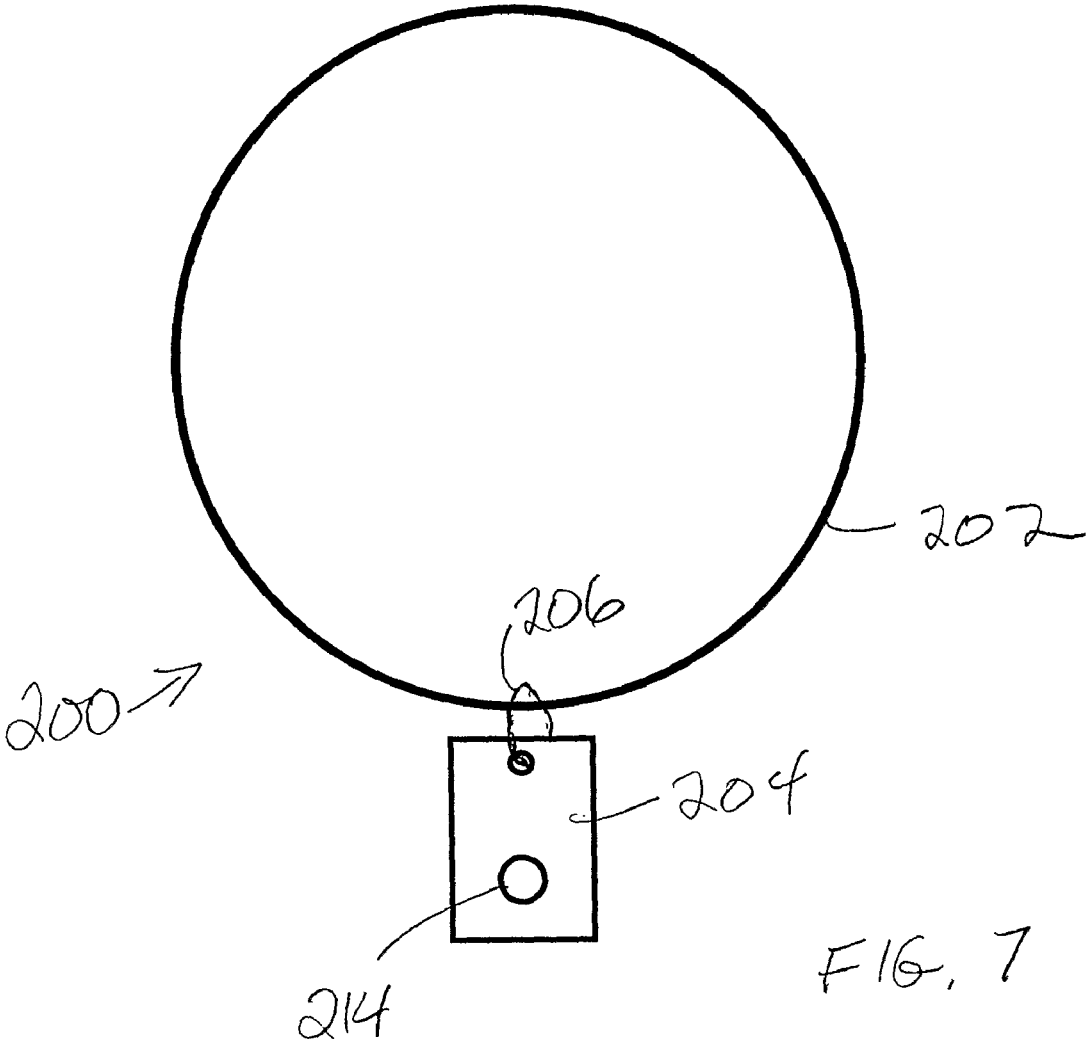
FIG. 7 is schematic side elevation view of a pendant according to the invention with a removable setting removed.
Figure 8:
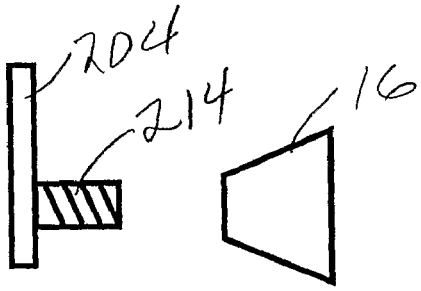
FIG. 8 is an exploded orthogonal view of the pendant and removable setting.

FIGS. 7 and 8 schematically illustrate a pendant 200 according to the invention, The pendant includes a neck chain 202 and a pendant element 204 attached to the chain 202 by a link or loop 206. According to this embodiment, the pendant element 204 has a threaded post 214 similar to the post 14 described in FIG. 1. A setting 16 like the setting described in FIG. 1 is adapted to threadably engage the post 214. Charms (20 in FIG. 2 or 120 in FIG. 5) can be placed on the post 214 and secured by attaching the setting 16.

Figure 9:
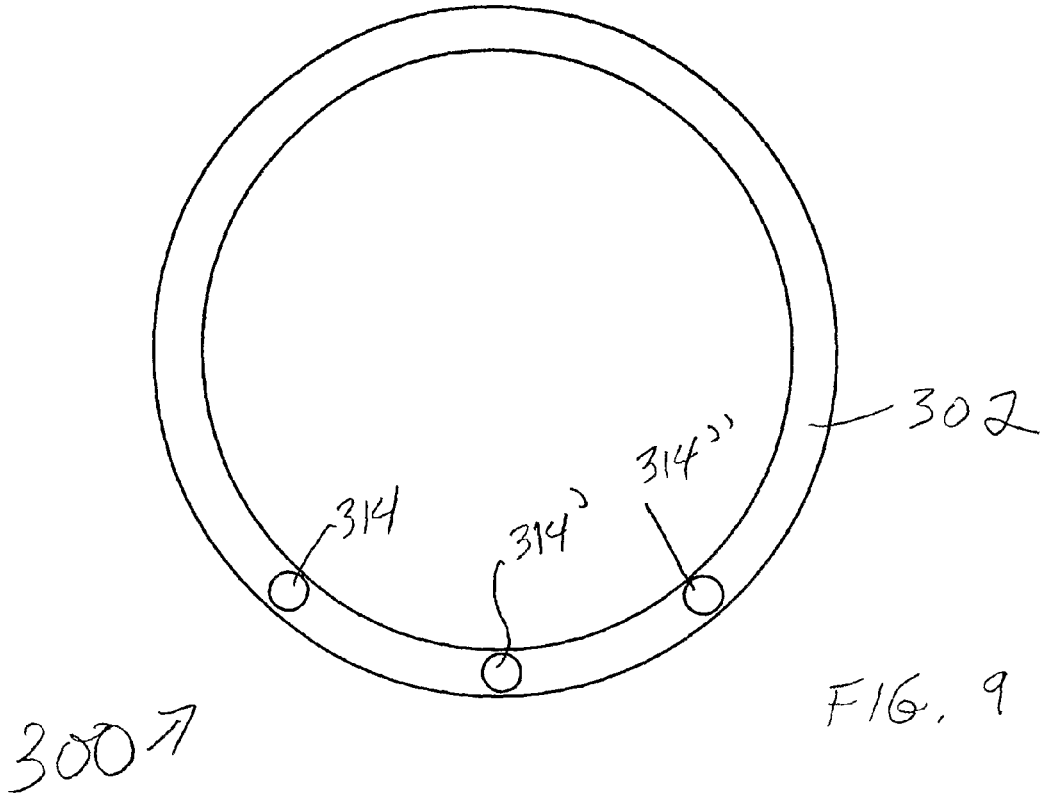
FIG. 9 is a schematic side elevation view of a necklace according to the invention with removable settings removed.
Figure 10:
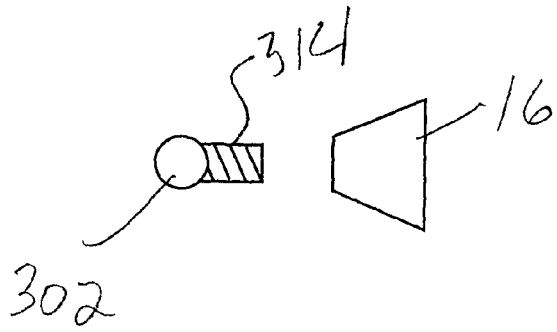
FIG. 10 is an exploded orthogonal view of a portion of the necklace and a removable setting.

FIG. 9 shows another example of neckwear according to the invention. A necklace 300 according to the invention includes a rigid or semi rigid neck ring 302 supporting three threaded posts 314, 314', and 314". Three settings 16 (FIG. 10) are provided and charms are attached to the posts as described above. As with the ring and pendant embodiments, the setting 16 can be interchanged with other settings having different aesthetic appeal, complimenting the charms, individualized for a birthstone, zodiac symbol, monogram, etc. In other words, jewelry according to the invention (e.g. rings, neckwear, bracelets and earrings) can be assembled as a system of settings, charms and jewelry items to which the settings and charms can be mixed and matched.

Figure 11:
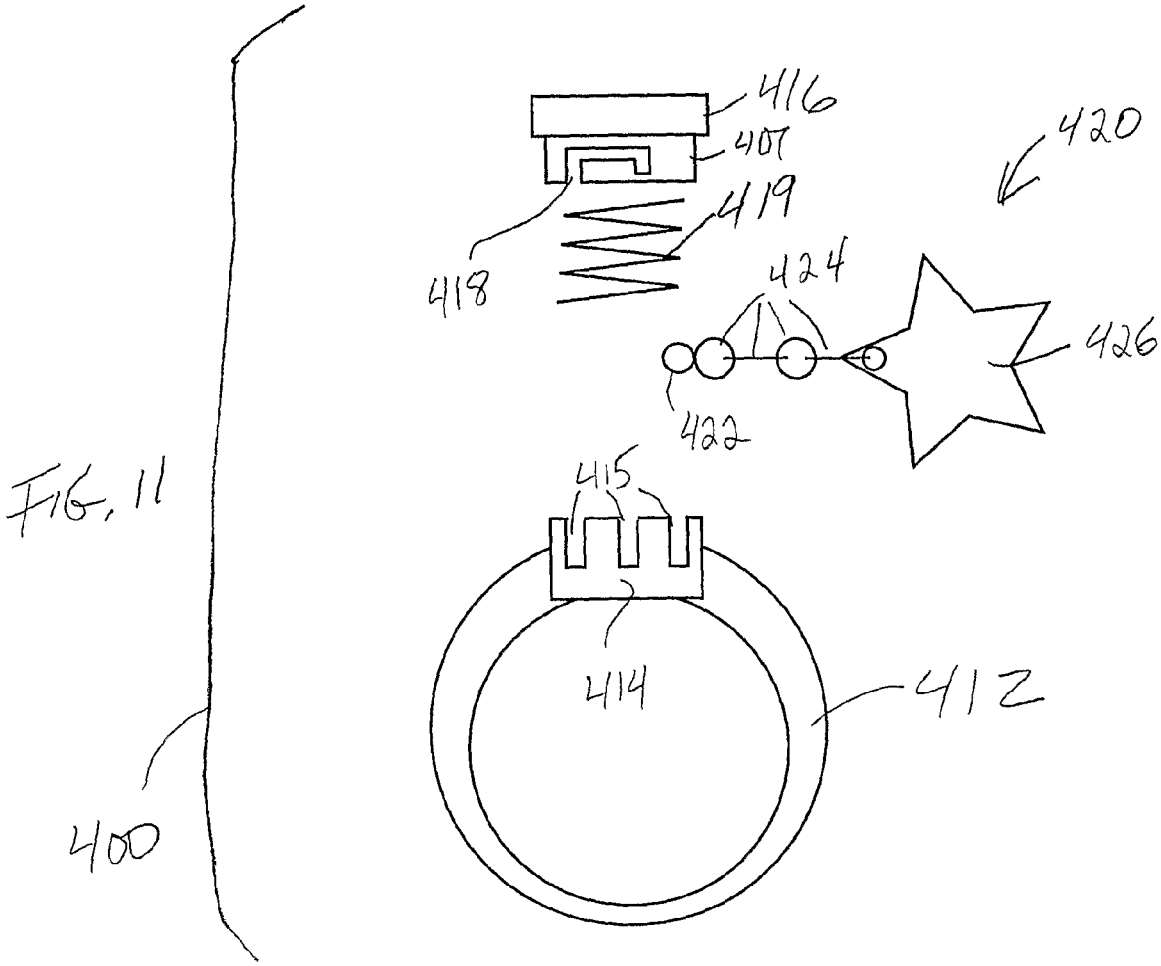
FIG. 11 is a schematic exploded side elevation view of a second embodiment of a ring according to the invention.
Figure 12:
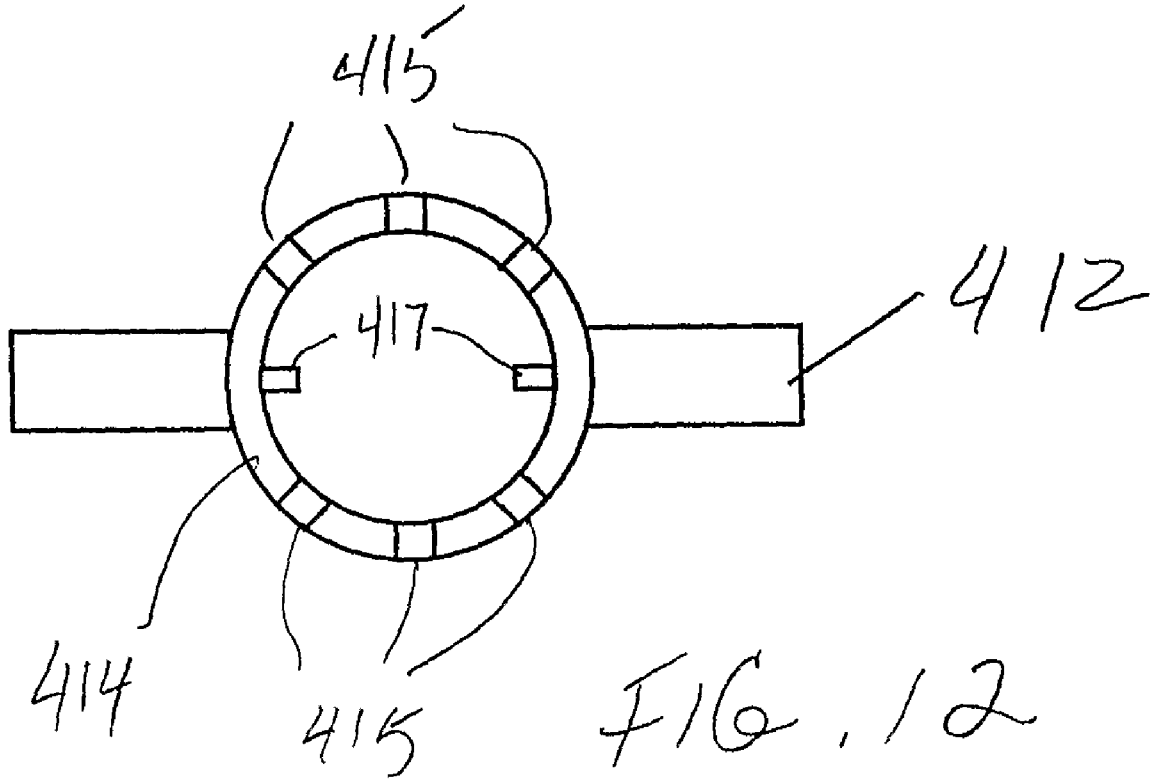
FIG. 12 is a schematic top view of the ring of FIG. 11 with the setting and charm removed.
Figure 13:
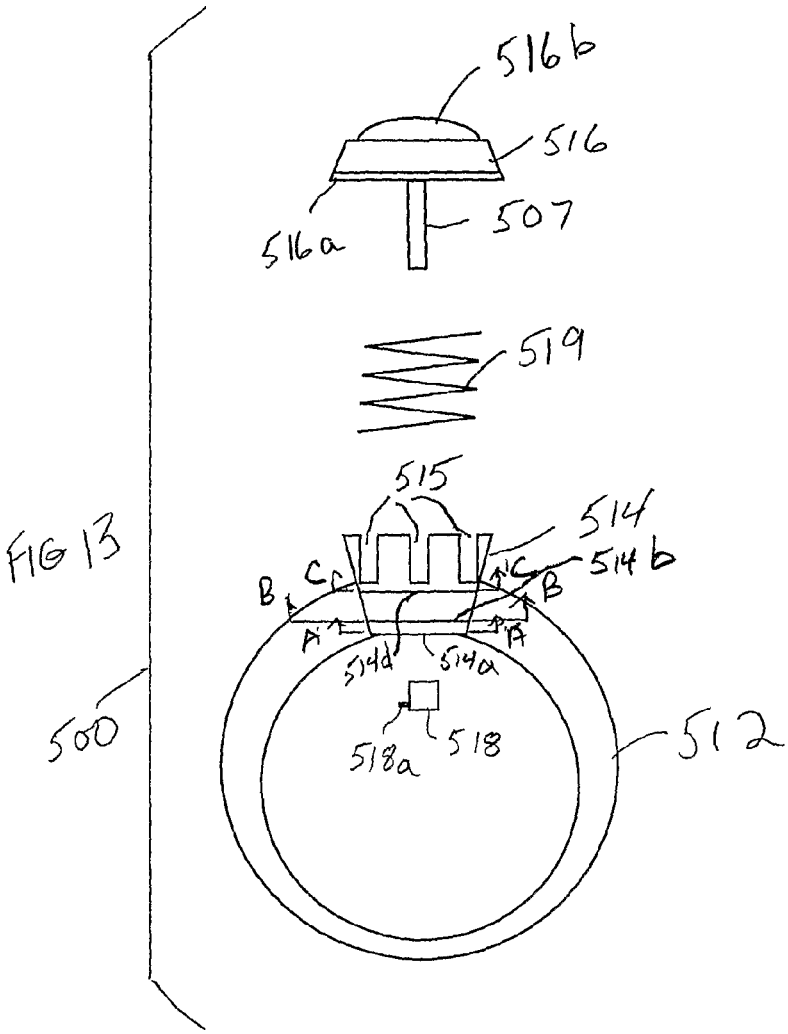
FIG. 13 is a schematic transparent exploded view illustrating a third embodiment of the invention.
Figure 16:
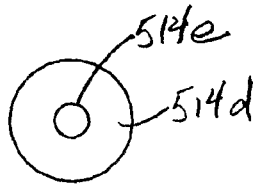
FIG. 16 is a section taken along line C-C in FIG. 13.
Figure 15:
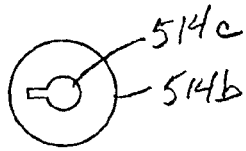
FIG. 15 is a section taken along line B-B in FIG. 13.

FIGS. 11 and 12 illustrate a second embodiment of a ring and charm assembly according to the invention. The assembly 400 includes a closed loop (ring) 412 which is dimensioned to fit comfortably over the wearer's finger. A substantially cylindrical "basket" 414 is mounted radially relative to the loop 412, The basket has a plurality of circumferential slots 415 and a pair of diametrically opposed interior bosses 417 (FIG. 12). A removable setting 416 is provided with a lower cylinder 407 having an external diameter smaller than the internal diameter of the basket 414. The cylinder 407 has a pair of diametrically opposed bayonet slots 418 which are dimensioned to receive respective bosses 417 on the basket 414 and a spring 419 having a diameter smaller than the interior diameter of the cylinder 407 is also provided. A charm 420 includes a mounting ball 422 coupled by one or more links 424 to a charm element 426. The mounting ball 422 has a diameter larger than the width of the slots 415 and the link 424 immediately connected to the ball 422 has a dimension which is narrower than the width of the slots 415. From the foregoing, those skilled in the art will appreciate that the ring and charm(s) are assembled by placing the ball(s) 422 in slot(s) 415, placing the spring 419 into the basket 414, placing the cylinder 407 over the spring 419, pressing the setting 416 into the basket with the opening to the bayonet slots 418 receiving the bosses 417, then turning the setting 416 until the bayonet slots 418 fully engage the bosses 417. When the setting 416 is released, the spring 419 will force the setting up slightly, thereby engaging the bosses in the vertical ends of the slots 418. In order to remove the setting, it must be pushed against the spring and turned in the opposite direction. So long as the setting is captured by the bosses, the ends of the slots 415 are covered by the setting and the charm(s) 420 are securely attached to the ring. It will also be appreciated that this arrangement of a slotted basket spring and bayonet lock can be applied to pendants and necklaces as well.

Figure 14:
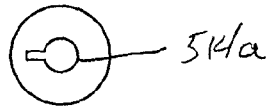
FIG. 14 is a section taken along line A-A in FIG. 13.
Figure 17:
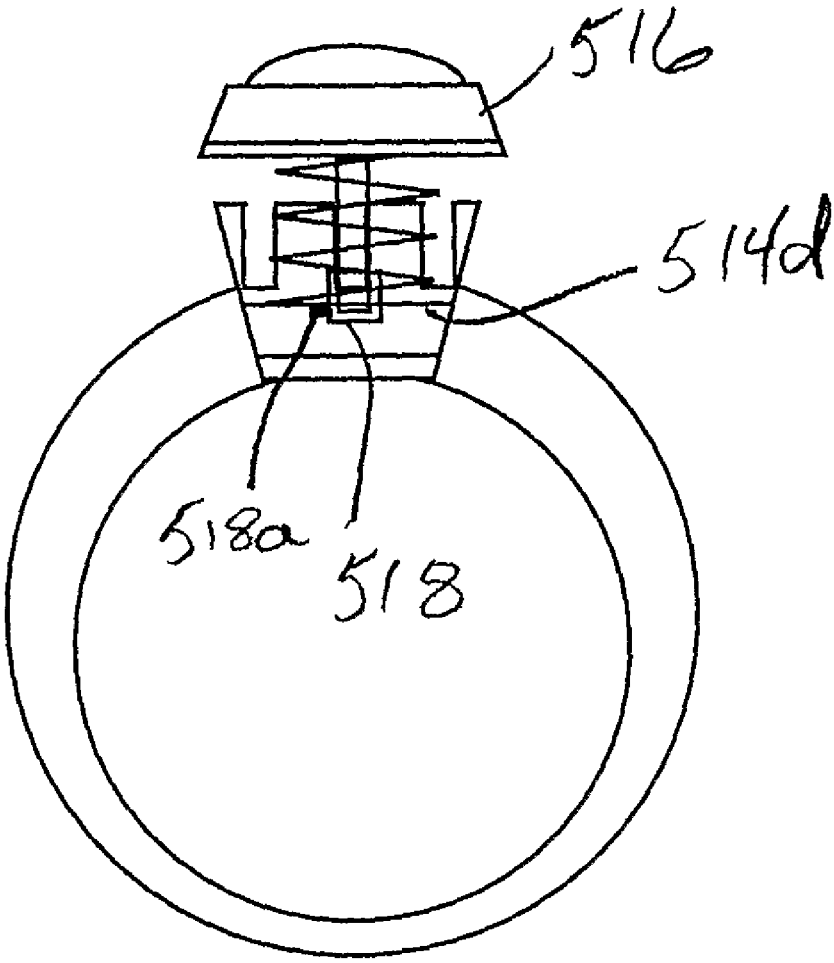
FIG. 17 is a schematic transparent side elevation view of the third embodiment assembled and with the setting moved to the upward open position.

FIGS. 13 through 18 illustrate a third embodiment of a ring assembly 500 according to the invention. The assembly includes a closed loop (ring) 512 with a frustoconical basket 514 mounted thereon. The basket 514 is provided with a plurality of slots 515 like the slots 415 in the third embodiment and they are dimensioned to capture charms of the type 420 (FIG. 11). A frustoconical setting 516 has a lower lip 516*a* which has a slightly larger diameter than the top of the basket 514. The setting 516 has an upper decorative stone 516*b* and a lower downward extending stem 507. A small cylinder 518 is provided with a radial boss 518*a* and a spring 519 is also provided. The bottom of the basket 514 has a keyhole 514*a* as shown in FIG. 14. A first disk 514*b* with a similar keyhole 514*c* is located inside the basket spaced up from the bottom of the basket. A second disk 514*d* having a circular hole 514*e* is located inside the basket 514 between the first disk 54*b* and the slots 515. The keyholes 514*a* and 514*c* are dimensioned to allow the passage of the cylinder 518 and boss 518*a*. The circular hole 514*e* is dimensioned to allow the passage of the cylinder 518 but not the boss 518*a*. The stem 507 is dimensioned to fit through all of the holes 514*a*, 514*c*, 514*e* an into the cylinder 518.

Figure 18:
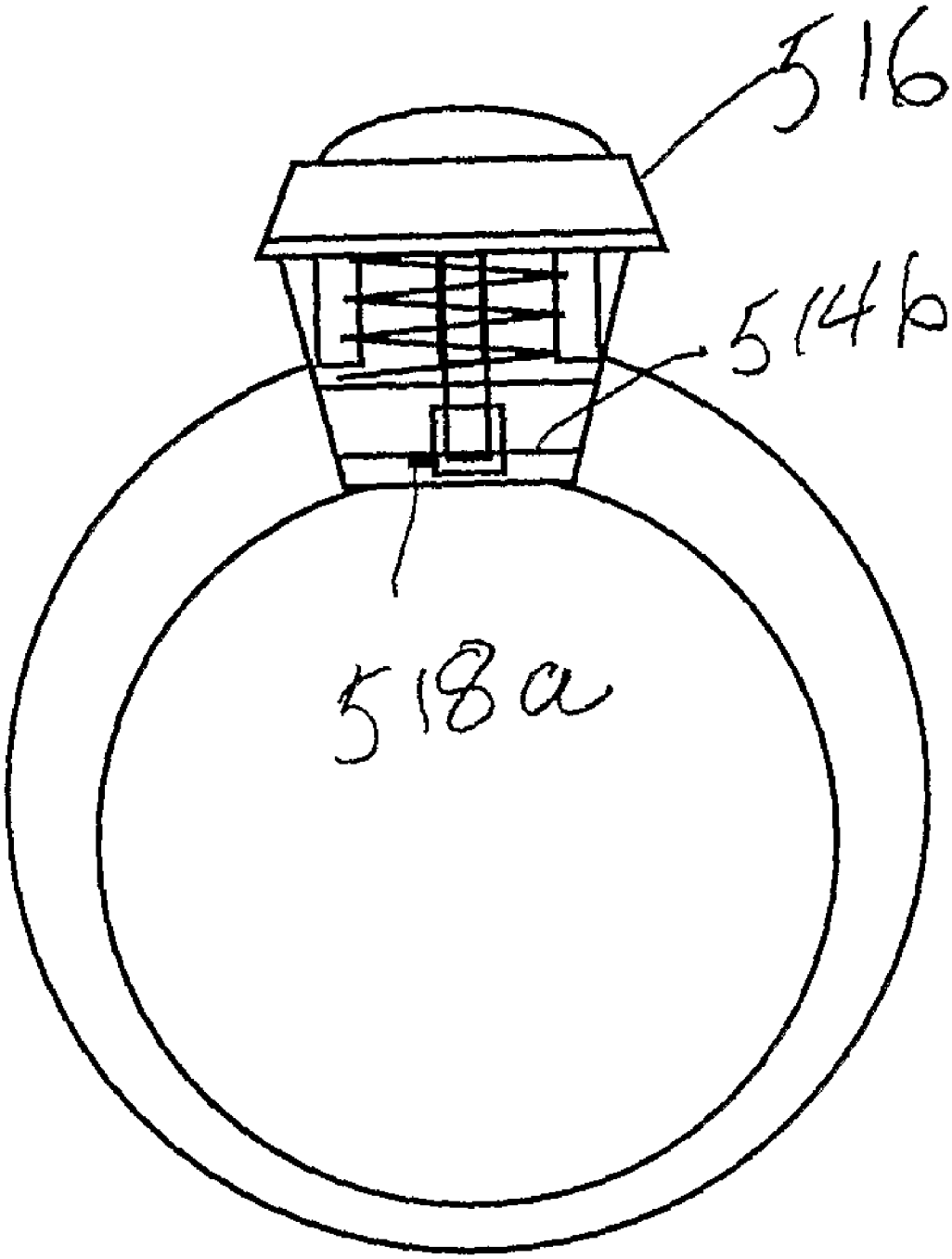
FIG. 18 is a schematic transparent side elevation view of the third embodiment assembled and with the setting moved to the downward closed position.

The ring assembly 500 is put together by placing the spring 519 into the basket 514 where it rests upon the disk 514*d*. The stem 507 of the setting 516 is then inserted through the spring and through the hole 514*e*. The setting is pressed down against the spring until the stem 507 extends through the hole 514*c* and into the hole 514*a*. The length of the stem is preferably long enough to lie flush with the bottom of the basket but not pass through it. The cylinder 518 with its boss 518*a* is then pressed through the keyhole 514*a* and onto the bottom of the stem 507. The cylinder is secured to the stem by any one or more of: force fitting, welding, gluing, etc. With the cylinder 518 securely coupled to the stem 507 of the setting, the setting can be released and, if the boss 518*a* is aligned with the keyway in the hole 514*c*, the spring 519 will lift the setting up to the position shown in FIG. 17 with the boss abutting the underside of the disk 514*d*. Pushing the setting down with the boss aligned with the keyway in the hole 514*c* will locate the boss beneath the disk 514*b* as shown in FIG. 18. Turning the setting so that the boss is no longer aligned with the keyway will trap the boss beneath the disk 514*b*. In this position, the lip 516*a* of the setting overlies the top of the basket 514.

It will be appreciated that in the embodiment pictured and described, the setting is free to rotate 360°. According to a preferred realization of this embodiment, rotation of the setting is limited to about 90° from an open to closed position. This is accomplished by placing rotation limiting structures (not shown) on the disks 514*b* and 514*d*.

Figure 19:
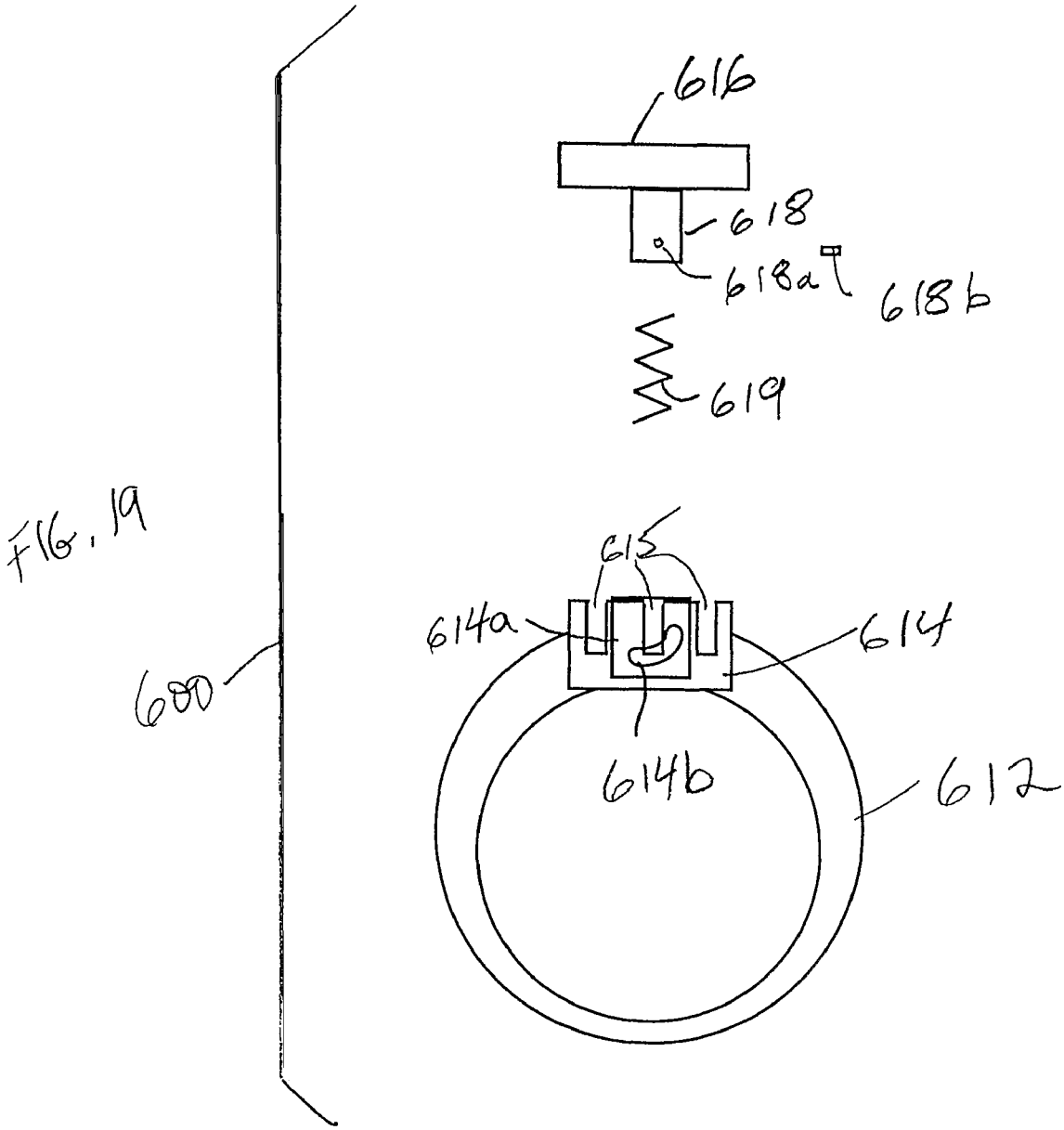
FIG. 19 is a schematic transparent exploded view illustrating a fourth embodiment of the invention.

FIG. 19 shows a fourth embodiment of a ring assembly according to the invention. The assembly includes a closed loop (ring) 612 and a basket 614 having slots 615. The setting 616 has a centrally located downward extending hollow post or cylinder 618 with a radial opening 618*a* dimensioned to receive a radial boss 618*b*. The basket 614 is provided with a central cylinder 614*a* which has a bayonet slot 614*b*. The bayonet slot is preferably L-shaped, J-shaped, or boomerang shaped. A spring 619 is provided and is dimensioned to fit inside the post 618. The cylinder 614*a*, the hollow post 618, and the boss 618*b* are dimensioned such that the post 618 fits inside the cylinder 614*a* and the boss 618*b* extends into the slot 614*b*.

The assembly 600 is put together inserting the spring 619 into the post 618, inserting the post and spring into the cylinder 614*a*, and inserting the boss 618*b* through the slot 614*b* into the radial hole 618*a* in the post 618. An alternate assembly method is to continue the slot 614*b* to the top of the cylinder 614*a* so that the post 618 with the boss 618*a* can be inserted into the cylinder and slot and then sealing off the top of the slot by welding or the like. Still another assembly method is to pull the boss out of the post into the slot after it is in the cylinder.

Figure 20:
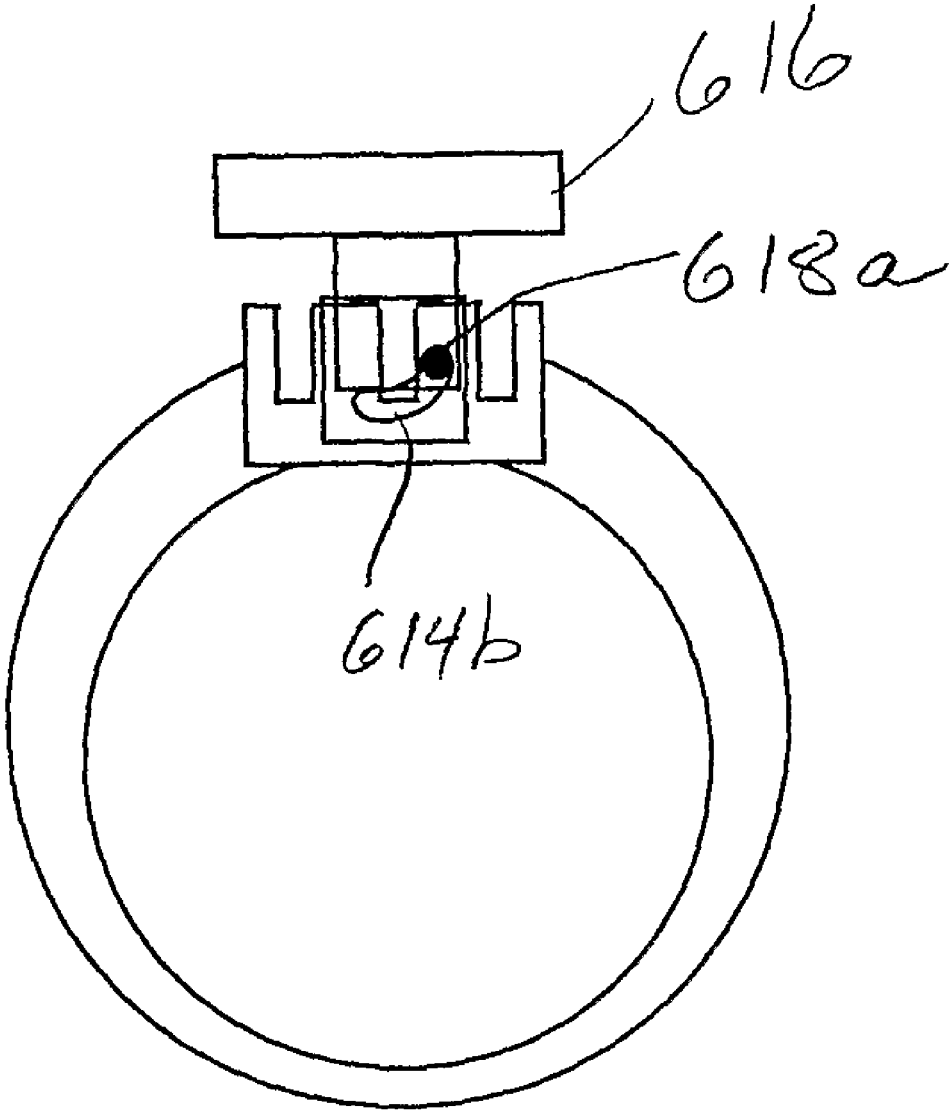
FIG. 20 is a schematic transparent side elevation view of the fourth embodiment assembled and with the setting moved to the upward open position.

When the assembly is put together as shown in FIG. 20, the setting 616 is biased upward and can be turned with the boss riding in the bayonet slot to an upward open position (shown) or to a downward closed position (not shown). This embodiment uses the same type of charms (420 in FIG. 11) as described above.

Figure 21:
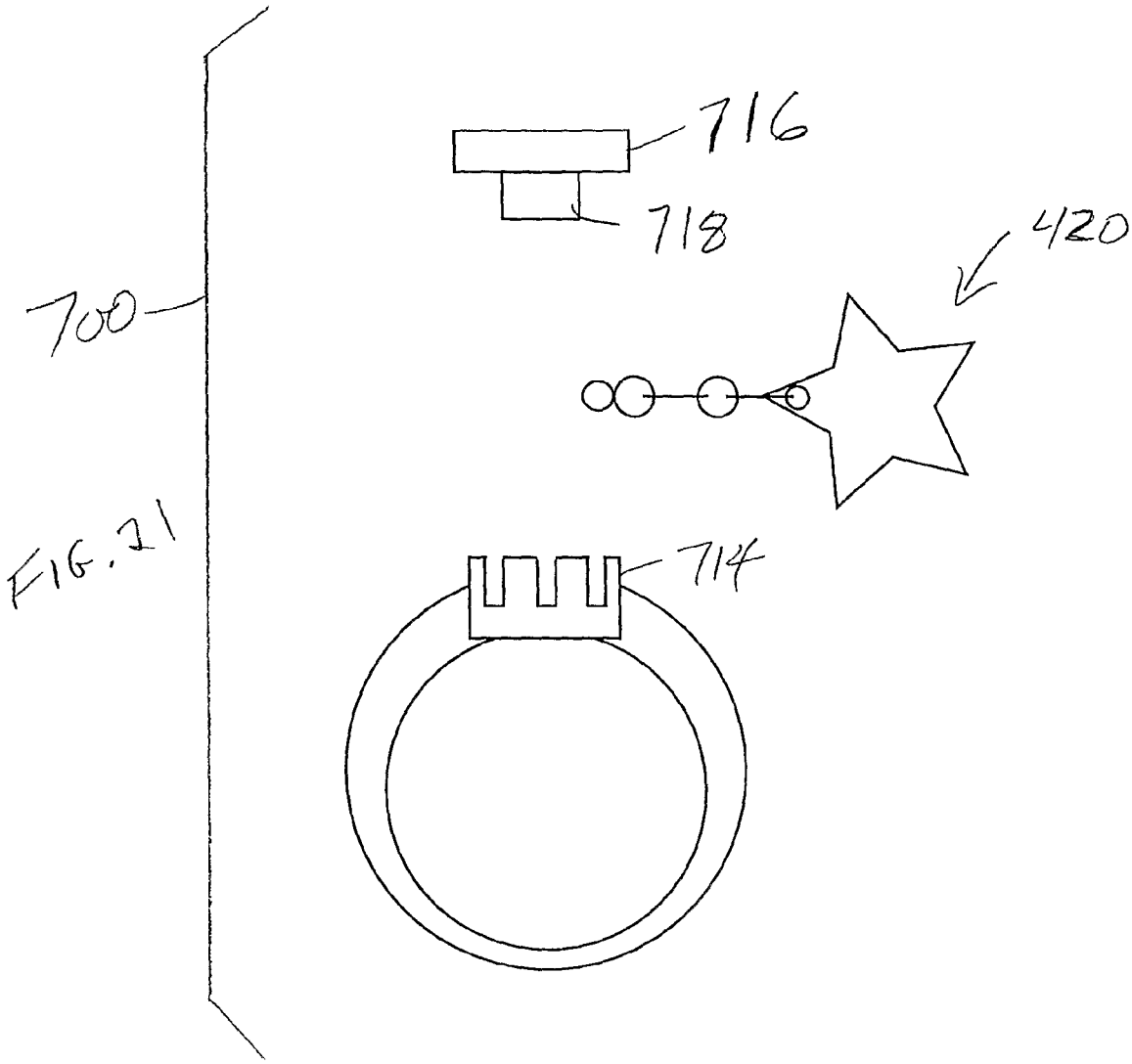
FIG. 21 is a schematic side elevation view of a fifth embodiment wherein the removable setting is coupled to the article of jewelry by one or more magnets.

FIG. 21 shows a ring 700 according to the invention where the setting 716 has a magnetic post 718 (or a magnet attached to the post) and/or a magnet is disposed inside the basket 714.

From the foregoing, it will be appreciated that the rings according to the invention all define a finger axis at the center of the closed loop and a setting axis which is perpendicular to the finger axis. Charms are attached to the rings (captured by the settings) on an axis substantially perpendicular to the setting access (not accounting for the flexibility of the link(s) coupled to the charms).

Figure 22:
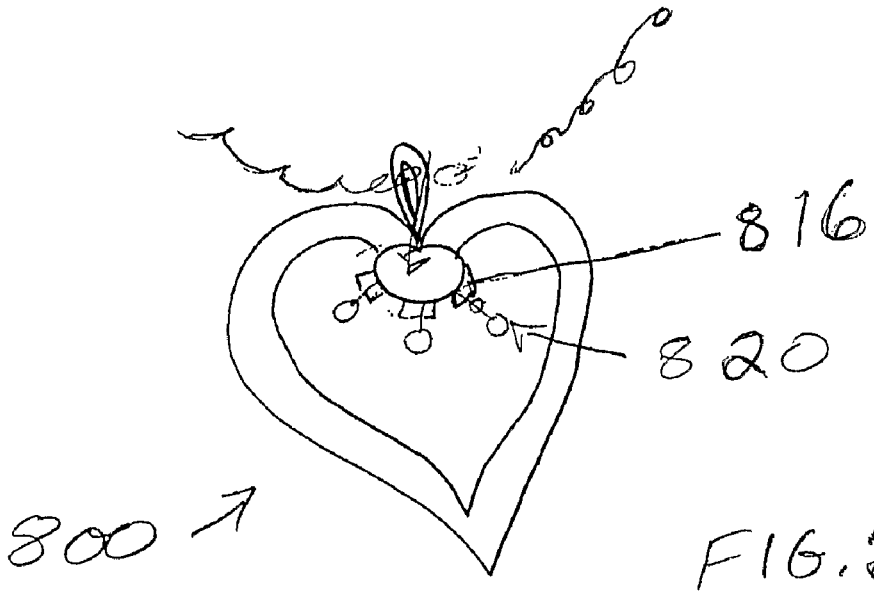
FIG. 22 is a schematic side elevation view of another pendant according to the invention.

FIG. 22 shows another pendant according to the invention having a setting 816 which is movable or removable and one or more interchangeable charms 820.

Figure 23:
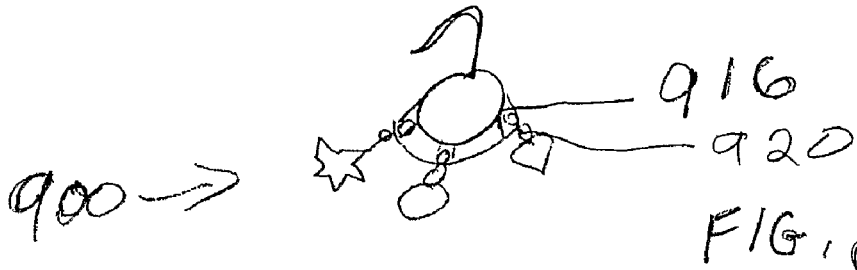
FIG. 23 is a schematic side elevation view of an earring according to the invention.

FIG. 23 shows an earring 900 according to the invention having a setting 916 which is movable or removable and one or more interchangeable charms 920.

Figure 24:
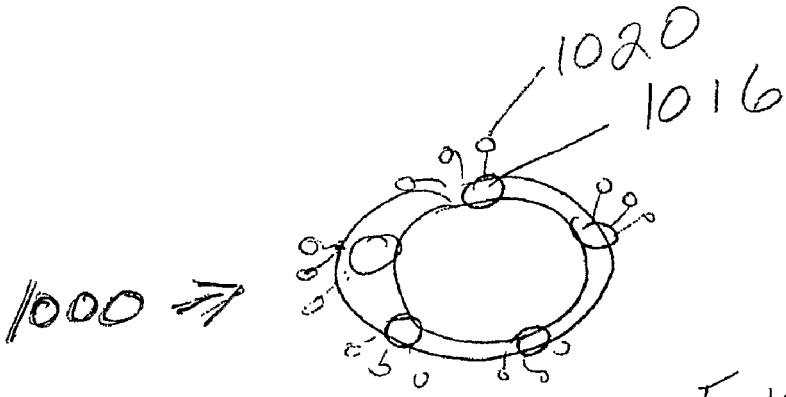
FIG. 24 is a schematic side elevation view of a bracelet according to the invention.

FIG. 24 illustrates a bracelet 1000 according to the invention having one or more settings 1016 which are movable or removable and one or more interchangeable charms 1020 associated with each setting.

There have been described and illustrated herein several embodiments of an item of jewelry and methods of assembling it. While particular embodiments of the invention have been described, it is not intended that the invention be limited thereto, as it is intended that the invention be as broad in scope as the art will allow and that the specification be read likewise. Thus, while a ring with up to six charms has been disclosed, the maximum number of charms could be greater or fewer. Also while charms have been shown with a chain or chain link connecting them to an end which is captured by a charm capturing fixture (e.g. threaded post or slot in a basket), the charms could be coupled by any flexible or rigid member to an end which is captured by a charm capturing fixture. Moreover, while the captured ends of charms have been illustrated and described as "balls", it will be appreciated that other shapes which perform the same function could be used. It will therefore be appreciated by those skilled in the art that yet other modifications could be made to the provided invention without deviating from its spirit and scope as claimed.

What is claimed is:

1. An item of jewelry for use by a person, comprising:

a ring-shaped element adapted to fit around a finger, arm, or neck of the person;

a charm capturing fixture coupled to said ring-shaped element;

a movable setting movable relative to said charm capturing fixture;

a plurality of charms, each charm coupled to an anchor which is captured by said charm capturing fixture when said movable setting is in a first position relative to said charm capturing fixture and can be independently removed when said movable setting is in a second position relative to said charm capturing fixture.

2. An item of jewelry according to claim 1, wherein:

said charm capturing fixture is a post with a first mating element, said setting having a second mating element removably coupled to said first mating element, and said anchor which is captured by said post is a loop.

3. An item of jewelry according to claim 2, wherein:

said first mating element includes threads on said post and said second mating element includes internal threads in said setting.

4. An item of jewelry according to claim 1, wherein:

said charm capturing fixture is coupled to a finger ring.

5. An item of jewelry according to claim 1, wherein:

at least one charm of said plurality of charms is selected from the group consisting of holiday themes, religious themes, astrological signs, varsity letters, graduation year, wedding themes, commercial characters such as Disney characters, TV characters, messages such as "I Love You".

6. An item of jewelry according to claim 1, wherein:

said ring-shaped element is a necklace.

7. An item of jewelry according to claim 1, wherein:

said ring-shaped element is a bracelet.

8. An item of jewelry for use by a person, comprising:

a ring-shaped element adapted to fit around a finger, arm, or neck of the person;

a charm capturing fixture coupled to said ring-shaped element;

a movable setting movable relative to said charm capturing fixture;

a charm coupled to an anchor which is captured by said charm capturing fixture when said movable setting is in a first position relative to said charm capturing fixture and can be removed when said movable setting is in a second position relative to said charm capturing fixture, wherein:

said charm capturing fixture is a slotted basket.

9. An item of jewelry according to claim 8, wherein:

said movable setting is coupled to said slotted basket by a bayonet mount.

10. An item of jewelry according to claim 9, further comprising:

a spring located between said slotted basket and said movable setting.

11. An item of jewelry according to claim 10, wherein:

said slotted basket has a pair of bosses and said movable setting has a pair of mating bayonet slots.

12. An item of jewelry according to claim 10, wherein:

said slotted basket has two spaced apart disks, a lower disk defining a keyhole and an upper disk defining a circular hole, said movable setting has a downwardly extending post with a radial boss, said post and said boss being movable through said keyhole but said boss being blocked by said upper disk.

13. An item of jewelry according to claim 10, wherein:

said slotted basket has a centrally located cylinder, and said movable setting has a centrally located post which extends into said cylinder.

14. An item of jewelry according to claim 13, wherein:

said post has a radially extending boss, and said cylinder has a bayonet slot which is engaged by said boss.

* * * * *

UNITED STATES PATENT AND TRADEMARK OFFICE

CERTIFICATE OF CORRECTION

PATENT NO. : 7,937,966 B2
APPLICATION NO. : 11/816249
DATED : May 10, 2011
INVENTOR(S) : Beth Golove et al.

It is certified that error appears in the above-identified patent and that said Letters Patent is hereby corrected as shown below:

Title page, left column, insert the following as Item (63) with the header "Related U.S. Application Data" -- Continuation-in-part of application No. 11/346,418, filed on February 2, 2006, now Pat. No. 7,322,212, which is a continuation-in-part of application No. 11/061,809, filed on February 18, 2005, now Pat. No. 7,222,503. --

Column 1, following the title, insert the following with the header "CROSS-REFERENCE TO RELATED APPLICATIONS" -- This application is a 371 national phase application of PCT/US06/05055, filed February 14, 2006, which is a continuation-in-part of US Serial No. 11/346,418, filed February 2, 2006, now US Patent No. 7,322,212, which is a continuation-in-part of US Serial No. 11/061,809, filed February 18, 2005, now US Patent No. 7,222,503. --

Signed and Sealed this
Twenty-seventh Day of March, 2012

David J. Kappos

David J. Kappos
*Director of the United States Patent and Trademark Office*